US007036907B2

(12) United States Patent
Jung et al.

(10) Patent No.: US 7,036,907 B2
(45) Date of Patent: May 2, 2006

(54) METHOD OF ADJUSTING PROCESS BLACK AND A DRIVER THEREOF

(75) Inventors: Sun-hae Jung, Gyeonggi-do (KR); Myoung-jin Oh, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/458,742

(22) Filed: Jun. 11, 2003

(65) Prior Publication Data

US 2004/0004646 A1 Jan. 8, 2004

(30) Foreign Application Priority Data

Jul. 6, 2002 (KR) ..... 10-2002-0039150

(51) Int. Cl.
*B41J 2/21* (2006.01)
*B41J 2/205* (2006.01)

(52) U.S. Cl. ..... 347/43; 347/15; 358/1.9

(58) Field of Classification Search ..... 347/43, 347/15, 16, 14; 358/1.2, 1.9, 2.1, 502, 529
See application file for complete search history.

(56) References Cited

U.S. PATENT DOCUMENTS 5,992,971 A 11/1999 Takahashi et al.
6,084,604 A * 7/2000 Moriyama et al. ..... 347/15
6,196,663 B1 * 3/2001 Wetchler et al. ..... 347/43

FOREIGN PATENT DOCUMENTS

KR 2002-41697 6/2002

OTHER PUBLICATIONS

Chinese Office Action for Application 03137851.X

* cited by examiner

*Primary Examiner*—Lamson Nguyen
(74) *Attorney, Agent, or Firm*—Staas & Halsey LLP

(57) ABSTRACT

A method of adjusting process black and a driver thereof. The method includes converting a part of process black data into mono black data. Accordingly, a user can arbitrarily adjust a ratio of process black to obtain a more natural output image and print the output image in process black and mono black, thereby reducing the consumption of ink or a colorant contained in process black.

13 Claims, 4 Drawing Sheets

METHOD OF ADJUSTING PROCESS BLACK AND A DRIVER THEREOF

CROSS-REFERENCE TO RELATED APPLICATIONS

This application claims the benefit of Korean Application No. 2002-39150, filed Jul. 6, 2002, in the Korean Intellectual Property Office, the disclosure of which is incorporated herein by reference.

BACKGROUND OF THE INVENTION

1. Field of the Invention

The present invention relates to outputting process black using an image outputting apparatus, and more particularly, to a method of adjusting a ratio of black in process black according to the attributes of an object to be printed during a printing operation and a driver thereof.

2. Description of the Related Art

An ink jet printer, which is one of general image outputting apparatuses, prints color images using four colors of ink, i.e., magenta, cyan, yellow, and black. However, such an ink jet printer is disadvantageous in that black ink spreads on a color region on the border between a black region and a color region. Therefore, the quality of the color region deteriorates and the border between the black and color regions is unclear, thereby lowering the quality of the overall image.

The reason why the black ink spreads over the color region is because black and color inks are different types. That is, black ink is evaporative colorant ink, but color ink is infiltrative colorant ink. To solve this problem, it is suggested that mono black be replaced with process black at the border between black and color regions, with respect to some pixels. Some black pixels adjacent to the border between the black and color regions are printed with process black, which is obtained by overlapping cyan, magenta, and yellow colors, while the other black pixels are printed with mono black. The process black is obtained by using ink of the same type for printing color regions, thereby minimizing spreading of black color on the border between black and color regions. Also, even if black ink spreads over a color region, the spreading of mono black ink over process black is not visually detected since the color region approximates black color.

FIG. 1 shows an example of a general user interface screen of an apparatus connected to a printer to control an output of the printer. Referring to FIG. 1, the user interface screen presents only an option of selecting whether process printing is to be used or not when printing target data, based on the type of the data, e.g., a text, a graphic, and an image. The process black printing in which a ratio of black is determined by a system is wholly applied to the data to be printed using the process printing.

FIG. 2 is a flowchart illustrating a conventional method of performing process black printing using a printer. Referring to FIG. 2, whether data is to be printed using process black is checked in operation 200.

If the data is not to be printed using the process black, mono black printing is performed on the print data using only black ink in operation 210.

If the print data is to be printed using the process black, a value of a mono black color determined by a system is converted into a value of process black color in operation 220. For instance, if the mono black value is 5, a magenta value M, a cyan value C, and a yellow value γ are set to 5, respectively, and then a mixture of these colors is output as process black.

The data is printed using the converted process black in operation 230.

However, this method is not recommended in that only an option of determining whether process black is used or not is presented in a user interface screen, i.e., a function of adjusting a ratio of black in the process black is not included in this method.

SUMMARY OF THE INVENTION

The present invention provides a method of adjusting process black, the method enabling a user to easily adjust a ratio of black in process black according to the attributes of print data and then print the data using the adjusted process black, and a driver thereof.

Additional aspects and advantages of the invention will be set forth in part in the description which follows and, in part, will be obvious from the description, or may be learned by practice of the invention.

The foregoing and/or other aspects of the present invention are achieved by providing a method of adjusting process black when printing a color image, wherein a part of data for process black is converted into data for mono black.

In an aspect of the present invention, a ratio of the mono black data is adjusted.

In another aspect of the present invention, a value of the mono black data is obtained by multiplying a value of the initial process black data by the ratio of the mono black data which is selected.

The foregoing and/or other aspects of the present invention may also be achieved by providing a method of adjusting process black when printing a color image, the method including checking if processing black is to be performed on an output image; calculating a first process black value using a cyan value C, a magenta value M, a yellow value Y, and a black value K, these values being included in the information regarding the image to be output and the information being provided together with the image; calculating a mono black value at a particular ratio with respect to the first process black, the ratio of the mono black value determined by a user; calculating a second process black value by subtracting the mono black value from the first process black value; and outputting the image using the mono black value and the second process black value.

In an aspect of the present invention, the overall color values are calculated by subtracting the first process black value from the C, M, and Y values to obtain subtraction values and adding the second process value to the subtraction values, respectively, the overall color values being used when printing the output image in process black.

In another aspect of the present invention, when printing the image in process black, the overall black value is obtained by adding the mono black value to the initial black value K.

According to still another aspect of the present invention, there is provided an image outputting driver which is connected to an image outputting apparatus to provide a user interface to control an output of the image outputting apparatus, the image outputting driver including a first selector which allows a user to select whether processing black is performed on the image; and a second selector which allows a user to select a ratio of process black when the first selector selects to carry out processing black on the image.

In an aspect of the present invention, the first selector provides a selection window to select whether processing black is carried out on a text, a graphic, or a picture.

In another aspect of the present invention, the second selector allows a user to select a ratio of process black within a range between 0% and 100%.

In yet another aspect of the present invention, a ratio of the mono black is obtained by subtracting the ratio of the process black from 100%.

In yet another aspect of the present invention, the image outputting driver further includes a process black calculator which calculates and reflects ratios of process black and mono black when the user selects the printing of the output image in a particular ratio of process black using the first and second selectors.

In still a further aspect of the present invention, the process black calculator calculates a first process black value using the C, M, Y, and K values, calculates a mono black value, calculates a second process black value by subtracting the mono black value from the first process black value, and applies the second process black value and the mono black value when printing the output image, the C, M, Y, and K values being provided from information together with the output image, and the mono black value whose ratio is determined based on the first process black value by a user.

In yet another aspect of the present invention, the first process black value corresponds to the minimum value of the C, M, and Y values.

In yet another aspect of the present invention, the overall color values are calculated by subtracting the first process value from the C, M, and Y values to obtain subtraction values, and adding the second process black value to the subtraction values, respectively.

In yet another aspect of the present invention, an overall black value is calculated by adding the mono black value to the K.

As mentioned above, the present invention relates to adjusting process black when printing a color image, and more particularly, converts some of the process black data into mono black data and outputs an image using the process black data and mono black data, unlike a conventional method of adjusting process black. According to an aspect of the present invention, a user can easily adjust a mono black value by multiplying the initial process black value by a ratio of the mono black.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DESCRIPTION OF THE PREFERRED EMBODIMENTS

Figure 1:
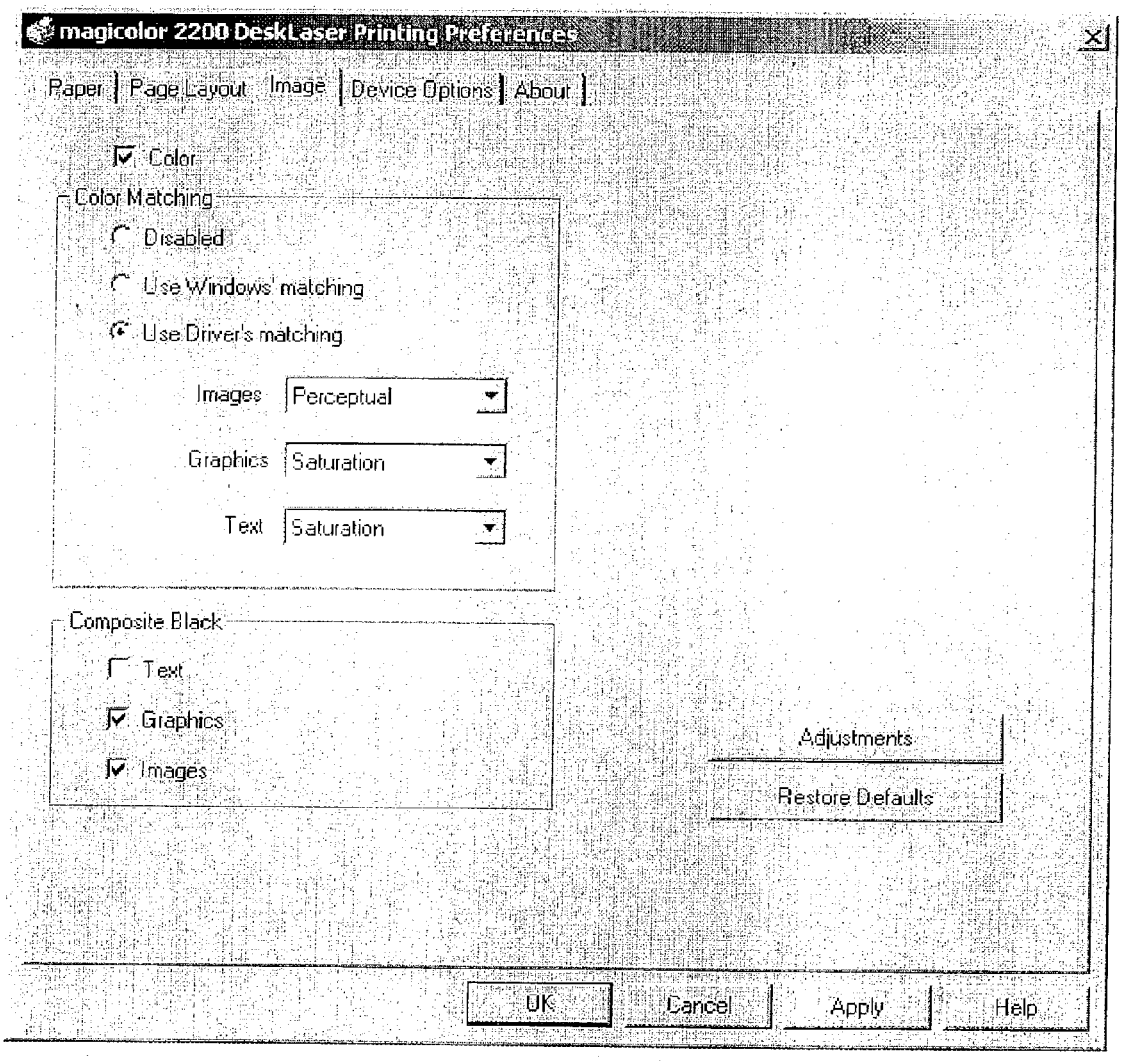
FIG. 1 (PRIOR ART)
FIG. 1 illustrates a general user interface screen of an apparatus connected to a printer to control an output of the printer.
Figure 2:
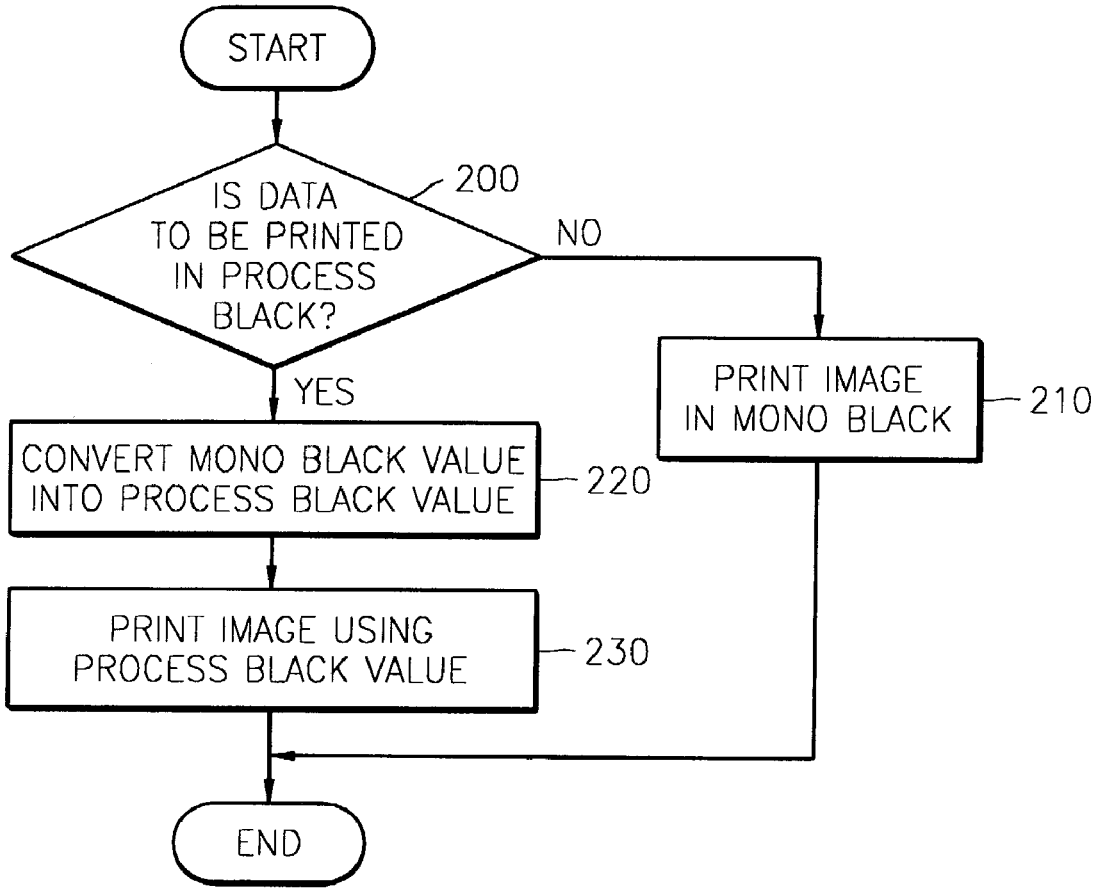
FIG. 2 (PRIOR ART)
FIG. 2 is a flowchart illustrating a method of performing process black printing using a general printer.

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

Figure 3:
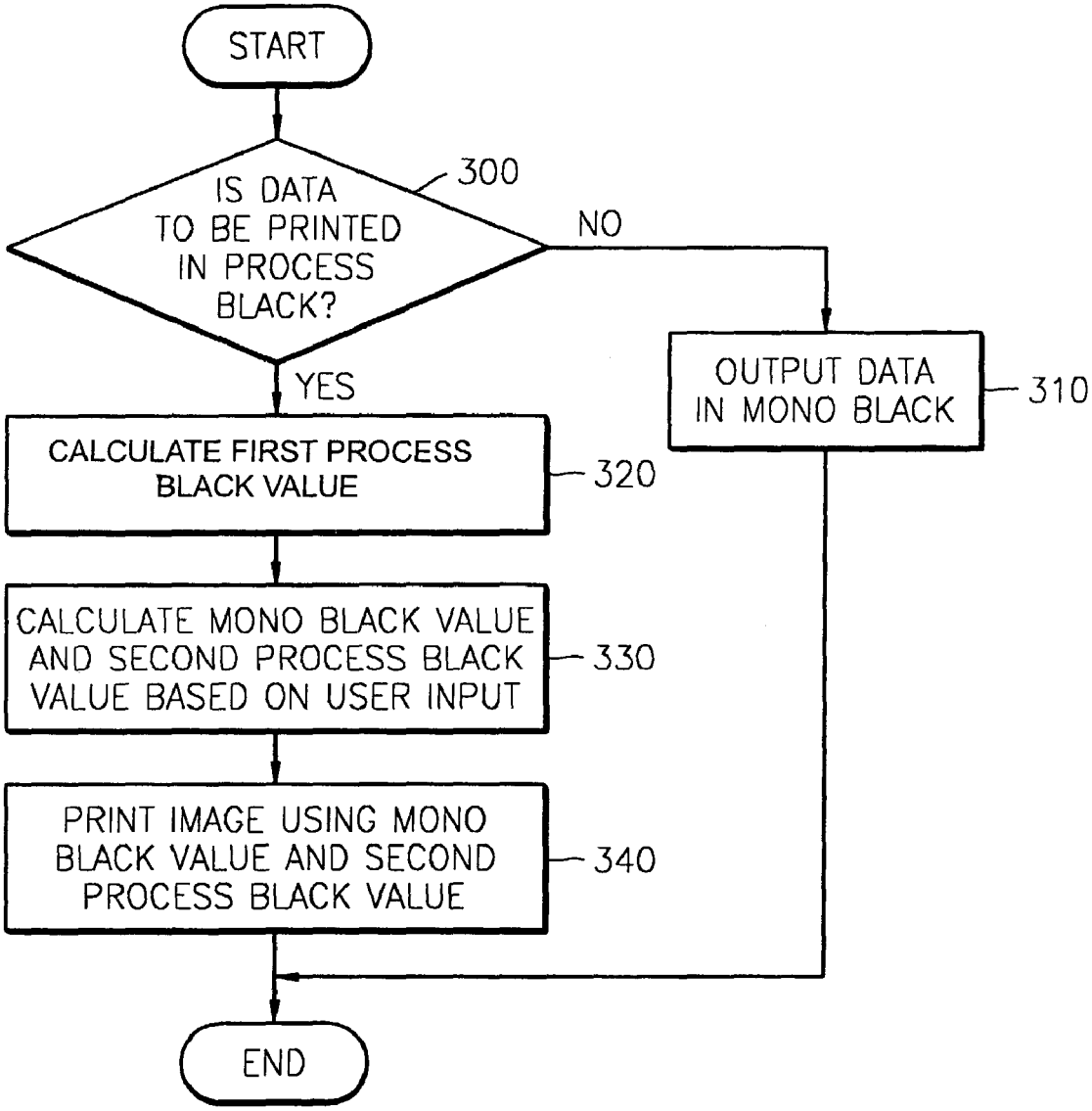
FIG. 3 is a flowchart illustrating a method of adjusting process black when printing a color image according to an embodiment of the present invention.

FIG. 3 is a flowchart illustrating a method of adjusting process black when outputting a color image. Referring to FIG. 3, whether data is to be printed in process black is checked when R.G.B is 0 in operation 300. If the process black is not used, mono black printing is performed using only a black color value Ko in operation 310.

If the process black is required, a first process black value is calculated using color information, which contains a cyan value C, a magenta value M, a yellow value Y, and a black value K, regarding a desired image which is input by a user in operation 320. For instance, if the color information discloses CMY 14, 11, and 16, and K 61, the minimum value 11 of CMY 14, 11, and 16 is selected as the first process black Kp. Next, converted values are respectively obtained by subtracting the first process black value from the other color values as follows:

$$\mathrm{Kp}=\mathrm{Minimum}(C, M, Y)$$

$$Cr=C-Kp$$

$$Mr=M-Kp$$

$$Yr=Y-Kp \tag{1}$$

After operation 320, a ratio PBR of process black or mono black is selected on the user interface screen, and then a second process black value Temp, which is a new process black value, and a mono black value mono are calculated while reflecting the selected ratio of process black (or the ratio of mono black), in operation 330. The example of calculating a second process black value and the mono black value is as follows:

$$\mathrm{mono}=Kp*PBR$$

$$\mathrm{Temp}=Kp-\mathrm{mono}$$

$$Kt=Ko+\mathrm{mono}$$

$$Ct=Cr+\mathrm{Temp}$$

$$Mt=Mr+\mathrm{Temp}$$

$$Yt=Yr+\mathrm{Temp} \tag{2},$$

wherein Kt, Ct, Mt, and Yt denote a black value, a cyan value, a magenta value, and a yellow value, which are applied to an overall output image, respectively. In other words, the first process black value is respectively subtracted from the C, M, and Y values to obtain subtraction values, and the second process black value is added to the subtraction values to obtain final values Ct, Mt, and Yt. The obtained final values are color values used when outputting an output image in process black. An overall black value Kt used when printing an image in process black is calculated by adding a mono black value mono to an initial black value Ko.

After operation 330, a portion of the overall output image is printed in mono black and the other portions thereof are printed using the second process black value, in operation 340.

Therefore, if an image is printed in process black, a certain percentage of process black and mono black are used together, thereby reducing the consumption of ink or a colorant contained in the process black and enabling an image to be more delicately depicted.

Figure 4:
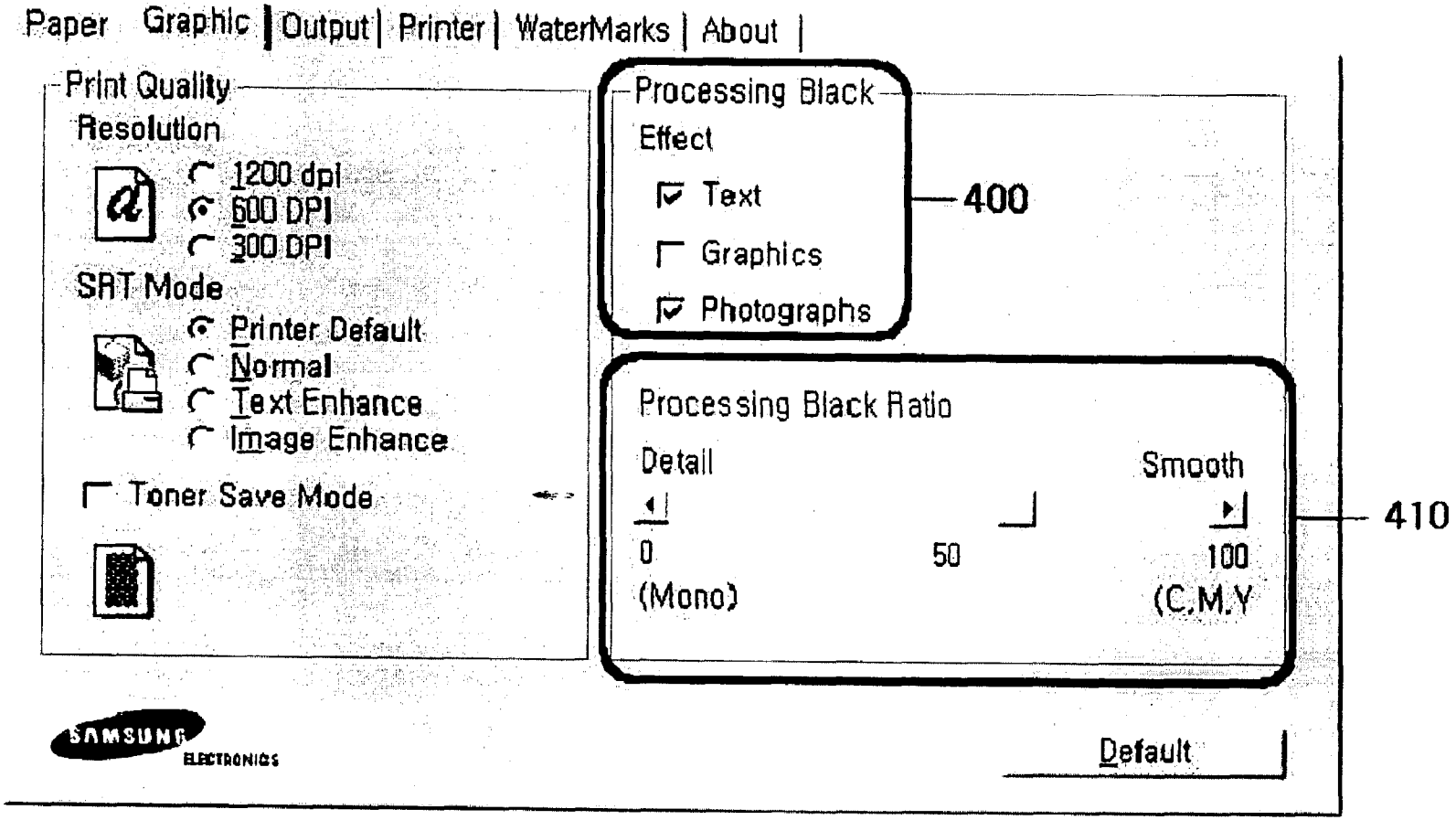
FIG. 4 illustrates a user interface of an image outputting driver performing the method of FIG. 3.

FIG. 4 shows a user interface screen to operate an image outputting driver that performs the method of FIG. 3. An image outputting driver is built into an apparatus, such as a computer, in order to provide a user interface and to control an output of an image outputting apparatus connected to a printer or a monitor. The image outputting driver includes a first selector 400 allowing a user to select whether processing black is performed on an image to be printed, and a second selector 410 allowing the user to select a ratio of process black when printing the image in process black.

More specifically, the first selector 400 provides a selection window through which the user selects whether a text, a graphic, or a picture is printed in process black. For instance, when processing black is selected on a window for selecting a text, the text of information to be printed is printed in process black. Also, when process only black is selected on windows to select a text and a picture, the text and picture of the information is printed in process black.

The second selector 410 allows a user to select a ratio of process black within a range between 0% and 100%. A ratio of mono black is calculated by subtracting the ratio of process black selected by the user from 100%.

Although not shown in FIG. 4, the image outputting driver may further include a process black calculator that calculates a process black value based on a selection made by the first and second selectors 400 and 410, and applies the process black value when printing an image.

In detail, the process black calculator calculates a first process black value Kp using C, M, Y, and K values obtained from the information regarding an output image which is provided together with the output image. The first process black value Kp may be calculated using the above equation 1. Next, a mono black value mono is calculated to have a particular ratio, as the user inputs, with respect to the first process black value. The mono black value mono may be calculated using the above equation 2. A second process black value Temp is calculated by subtracting the mono black value mono from the first process black value Kp. Color values used for the print of the image in process black are obtained by subtracting the first process black value from C, M, and Y values and adding the second process black values to the subtraction values, respectively, as suggested in equation 2. Also, when outputting the image in process black, an overall black value is calculated by adding the mono black value mono to an initial black value K. Lastly, the image is output using the second process black value, the color values, and the mono black value which are calculated using the process black calculator.

As described above, according to the present invention, a user can arbitrarily adjust a ratio of process black to obtain a more natural output image. Further, process black and mono black are used together when an image is output, thereby reducing consumption of ink or a colorant contained in the process black.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A method of adjusting process black when printing a color image, comprising:

converting a part of data for process black into data for mono black; and adjusting a ratio for the mono black data, wherein a value of the mono black data is obtained by multiplying a value of the initial process black data by the adjusted ratio for the mono black data as selected by a user.

2. A method of adjusting process black when printing a color image, the method comprising:

checking if processing black is to be performed on an output image;

calculating a first process black value using a cyan value C, a magenta value M, a yellow value Y, and a black value K regarding the image to be output and the information being provided together with the image;

calculating a mono black value at a particular ratio with respect to the first process black, the ratio of the mono black value being determined by a user;

calculating a second process black value by subtracting the mono black value from the first process black value; and outputting the image using the mono black value and the second process black value.

3. The method of claim 2, wherein overall color values are calculated by subtracting the first process black value from the C, M, and Y values to obtain subtraction values and adding the second process value to the subtraction values, respectively, the overall color values being used when printing the output image in process black.

4. The method of claim 2, wherein when printing the image in process black, the overall black value is obtained by adding the mono black value to the initial black value K.

5. An image outputting driver to control an output of an image outputting apparatus, the image outputting driver comprising:

a first selector which allows a user to select whether processing black is performed on the image; and a second selector which allows the user to select a ratio of process black when the first selector selects to carry out processing black on the image.

6. The image outputting driver of claim 5, wherein the first selector provides a selection window to select whether processing black is carried out on a text, a graphic, or a picture.

7. The image outputting driver of claim 5, wherein the second selector allows the user to select a ratio of process black within a range between 0% and 100%.

8. The image outputting driver of claim 7, wherein a ratio of the mono black is obtained by subtracting the ratio of the process black from 100%.

9. The image outputting driver of claim 7, further comprising a process black calculator which calculates and reflects ratios of process black and mono black when the user selects the printing of the output image in a particular ratio of process black using the first and second selectors.

10. The image outputting driver of claim 9, wherein the process black calculator calculates a first process black value using the C, M, Y, and K values, calculates a mono black value, calculates a second process black value by subtracting the mono black value from the first process black value, and applies the second process black value and the mono black value when printing the output image, the C, M, Y, and K values being provided from information together with the output image, and the mono black value whose ratio is determined based on the first process black value by a user.

11. The image outputting driver of claim 10, wherein the first process black value corresponds to the minimum value of the C, M, and Y values.

12. The image outputting driver of claim 10, wherein the overall color values are calculated by subtracting the first process value from the C, M, and Y values to obtain subtraction values and adding the second process black value to the subtraction values, respectively.

13. The image outputting driver of claim 10, wherein an overall black value is calculated by adding the mono black value to the K value.

* * * * *